United States Patent [19]

Trimble

[11] Patent Number: 5,017,313

[45] Date of Patent: May 21, 1991

[54] METHOD AND MEANS FOR REPAIRING EXISTING MANHOLE

[75] Inventor: Carroll O. Trimble, Springdale, Ark.

[73] Assignee: Action Products Marketing Corporation, Johnston, Iowa

[21] Appl. No.: 589,280

[22] Filed: Sep. 27, 1990

Related U.S. Application Data

[63] Continuation-in-part of Ser. No. 441,880, Nov. 27, 1989, which is a continuation-in-part of Ser. No. 240,073, Sep. 2, 1988, abandoned.

[51] Int. Cl.[5] ..... B28B 1/16; B28B 7/28; E02D 29/12; E04G 11/20

[52] U.S. Cl. ..... 264/32; 249/10; 249/11; 249/165; 249/184; 249/189; 264/35; 264/36; 264/219; 264/256; 264/269; 425/11; 425/59

[58] Field of Search ..... 264/31-36, 264/219, 254, 256, 274, 275, 277, 279, 279.1, 262, 269; 425/11, 59, 63; 249/1, 10-12, 144, 145, 176, 177, 184, 188, 189, 179, 163-167

[56] References Cited

U.S. PATENT DOCUMENTS

| | | | |
|---|---|---|---|
| 992,782 | 5/1911 | Lambie . | |
| 3,542,327 | 11/1970 | Herzog | 249/65 |
| 3,729,165 | 4/1973 | Trimble | 249/144 |
| 3,745,738 | 7/1973 | Singer | 52/741 |
| 3,815,214 | 6/1974 | Kyle, Sr. | 29/450 |
| 3,847,339 | 11/1974 | Farrell | 249/1 |
| 4,081,167 | 3/1978 | Heinzle | 249/10 |
| 4,085,918 | 4/1978 | Wilkerson | 249/11 |
| 4,119,291 | 10/1978 | Polito | 249/11 |
| 4,127,990 | 12/1978 | Morrow | 405/36 |
| 4,205,949 | 6/1980 | Hanson | 425/59 |
| 4,261,541 | 4/1981 | Morrow | 249/10 |
| 4,355,453 | 10/1982 | Pause et al. | 29/460 |
| 4,484,724 | 11/1984 | Srackangast | 249/11 |
| 4,799,824 | 1/1989 | Kumai et al. | 405/156 |

FOREIGN PATENT DOCUMENTS

| | | | |
|---|---|---|---|
| 1197007 | 7/1965 | Fed. Rep. of Germany . | |
| 5239953 | 9/1975 | Japan . | |
| WO/02847 | 3/1990 | PCT Int'l Appl. | 264/32 |

OTHER PUBLICATIONS

Action Products Marketing Corporation, "Manhole Liner Designed to Save Big Bucks", Action Products Sales Flyer, 1985, pp. 1-4.

*Primary Examiner*—Jan H. Silbaugh
*Assistant Examiner*—Karen D. Kutach
*Attorney, Agent, or Firm*—Zarley, McKee, Thomte, Voorhees & Sease

[57] ABSTRACT

A form assembly for casting a lining wall in an existing manhole includes a cylindrical lower form assembly, a circular horizontal form assembly, and a cylindrical upper form assembly. All three assemblies are formed of smaller segments which are assembled together within the manhole and which can be disassembled after the manhole has been repaired.

8 Claims, 2 Drawing Sheets

METHOD AND MEANS FOR REPAIRING EXISTING MANHOLE

BACKGROUNG OF THE INVENTION

This application is a continuation-in-part of application Ser. No. 441,880, filed Nov. 27, 1989, which is a continuation-in-part of application Ser. No. 240,073, filed Sept. 2, 1988, now abandoned.

The present invention relates to a method and apparatus for casting concrete liners in existing deteriorated manholes so that they will have many years of useful, substantially maintenance-free life.

Precast concrete manhole walls have been known for many years. Examples of such construction methods are shown in U.S. Pat. No. 3,729,165 granted Apr. 24, 1973 to Carroll O. Trimble. This particular prior art device shows forms which are used for constructing a new manhole as opposed to repairing an existing manhole. However, there are several problems encountered in repairing existing manholes that are not encountered in preparing a completely new manhole form.

Existing manholes often are irregular in shape, and require special forms which can be shaped to conform to the interior irregularities of the existing manhole. One problem encountered with existing manholes is the ability to construct a form which will fit a manhole having a lower portion of a first large diameter and having an upper portion of a substantially reduced diameter.

Therefore, a primary object of the present invention is the provision of an improved method and means for repairing existing manholes, wherein a form can be provided which conforms to a manhole having a large diameter lower portion and a reduced diameter upper portion.

A further object of the present invention is the provision of an improved method and means for repairing existing manholes, wherein the forms are capable of being disassembled for insertion into the manhole and reconstructed while within the manhole.

A further object of the present invention is the provision of an improved method and means for repairing existing manholes, wherein the form can be used during the casting process and can be disassembled and removed from the manhole after the casting process is complete.

A further object of the present invention is the provision of a method and means for repairing existing manholes, wherein an acid resistant plastic liner can be placed and adhered to the interior surface of the completed manhole.

A further object of the present invention is the provision of an improved method and means for repairing existing manholes which is efficient in operation, economical to use, and sturdy in construction.

SUMMARY OF THE INVENTION

The present invention utilizes a lower form assembly which is adapted to be placed within the enlarged diameter portion of the manhole. An upper form assembly is utilized for placing within the upper and reduced diameter portion of the manhole. Between the upper and lower form assemblies is a circular horizontal form assembly which interconnects the upper and lower form assemblies. The horizontal form assembly includes an outer diameter which is larger than the upper reduced diameter portion of the manhole and which is smaller than the lower enlarged diameter portion of the manhole. The horizontal frame assembly also includes an inner diameter which is less than the diameter of the reduced diameter portion of the manhole. The upper form assembly is registered over the inner diameter of the horizontal form assembly and is attached thereto. The resulting configuration creates an annular space between the form assembly and the interior walls of the manhole so that the space can be filled with concrete to form a new interior wall for the manhole.

The lower form assembly, the horizontal form assembly, and the upper form assembly are each comprised of small form segments which are joined together to form the entire assembly. Thus, it is possible to assemble the forms within the manhole, assembling each segment one to another until the entire form assembly is complete. The horizontal form assembly includes a plurality of pie shaped segments which can be disassembled for insertion into the manhole and which can be reassembled to create the horizontal form assembly.

If desired, a plastic liner can be placed around the outside of the lower form assembly, the upper form assembly, and the horizontal form assembly before pouring the concrete.

After the concrete is poured into the space between the form assembly and the walls of the manhole, it is permitted to harden. The plastic sheet material on the outside of the form assembly includes ribs which protrude into the concrete and which after hardening of the concrete cause the plastic liner to be strongly bonded to the concrete.

After the concrete has hardened, the lower form assembly is disassembled and removed from the manhole. This permits the removal of the horizontal form assembly which is disassembled and removed from the manhole. Finally, the upper form assembly is disassembled and removed, thereby leaving the new interior walls of the manhole in place with the plastic liner bonded thereto. Any seams which exist between the various portions of plastic sheet material are sealed by heat sealing or other conventional means. The result is a new manhole wall which is covered with an acid resistant plastic and which will last for many years.

DETAILED DESCRIPTION OF PREFERRED EMBODIMENT

Figure 1:
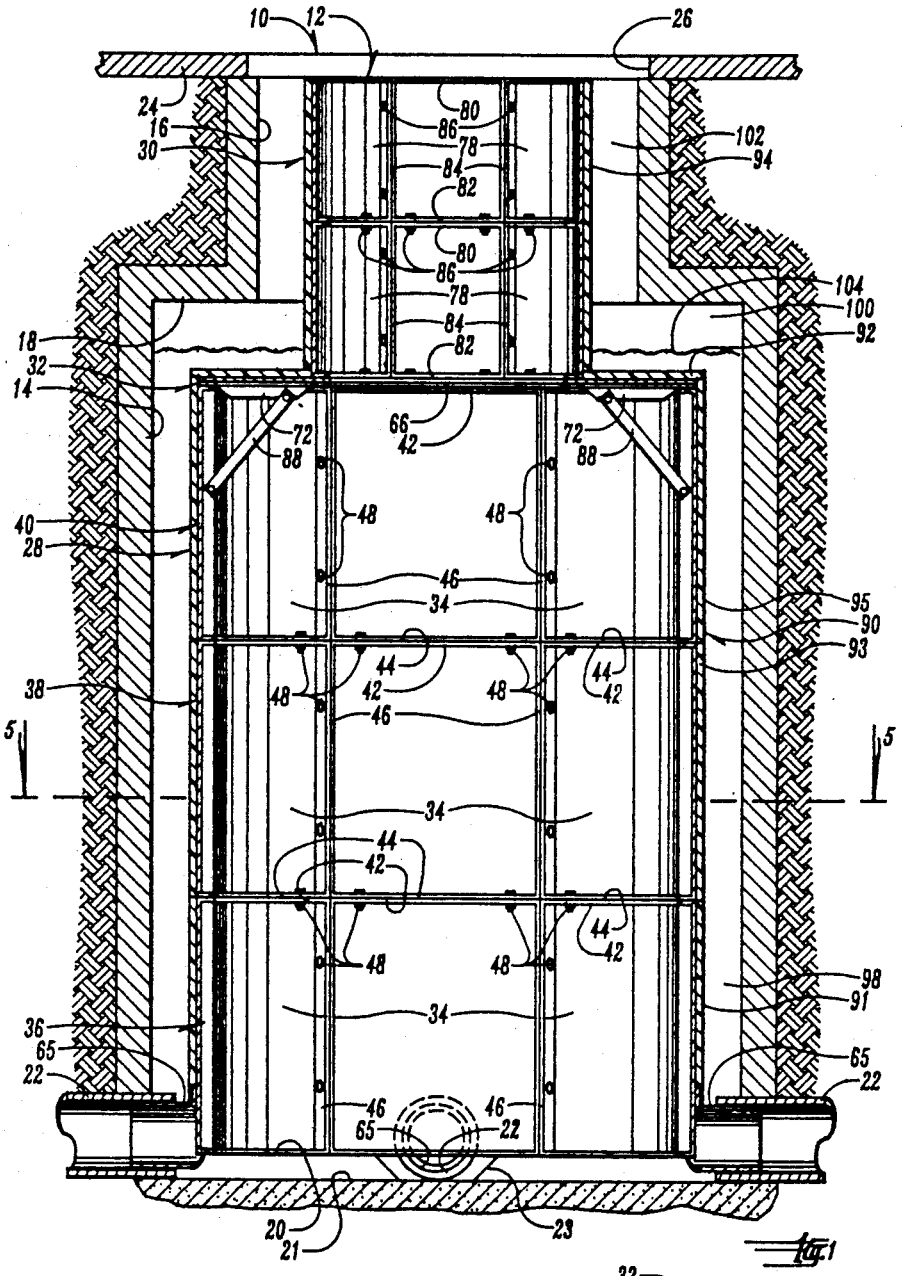
FIG. 1 is a sectional view of an existing manhole having the forms of the present invention placed therein.
Figure 2:
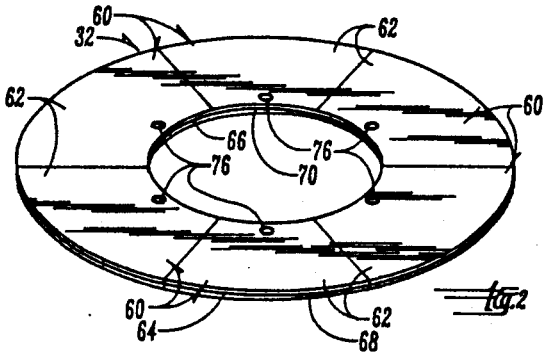
FIG. 2 is a perspective view of the horizontal form assembly of the present invention showing the upper surface thereof.
Figure 3:
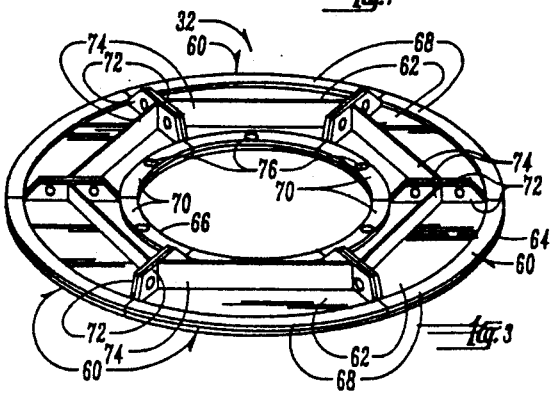
FIG. 3 is a perspective view of the horizontal form assembly showing the undersurface thereof.

Referring to the drawings, the numeral 10 generally refers to a manhole which is in need of repair. The numeral 12 refers to the form system of the present invention.

Manhole 10 includes a lower cylindrical wall 14, an upper cylindrical wall 16, and an annular horizontal wall 18 which is between the two upper and lower cylindrical walls 14, 16. The upper cylindrical wall 16 has a substantially reduced diameter from the lower wall 14. At the bottom of the manhole is a floor 20 which has troughs 21, 23 extending diametrically across the manhole. Extending inwardly through the walls of the manhole in alignment with the troughs 21, 23 are a plurality of sewer pipes 22. An upper concrete surface 24 surrounds the manhole and forms a circular manhole opening 26. The manhole walls 14, 16, and 18, in many manholes often become pocked, cracked, or worn to the point where they are no longer useful. It is therefore desirable to provide a new liner for these walls in order to repair the manhole.

The form system 12 is utilized to repair the manhole. It is shown in FIG. 1 to be in a fully assembled state. However, it is comprised of a plurality of form segments which are combined to form a lower form assembly 28, an upper form assembly 30, and a horizontal form assembly 32. Lower form assembly 28 is comprised of a plurality of arcuate lower form segments 34 which are combined to form a first ring 36, a second ring 38, and a third ring 40 which are stacked upon one another. Each form segment 34 includes flanges around its perimeter including upper flanges 42, lower flanges 44, and side flanges 46. These flanges are bolted together by bolts 48.

Figure 5:
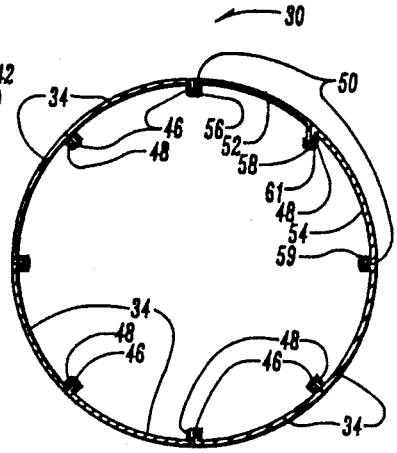
FIG. 5 is a reduced sized sectional view taken along line 5—5 of FIG. 1 showing the key forms which are used in the present invention.
Figure 6:
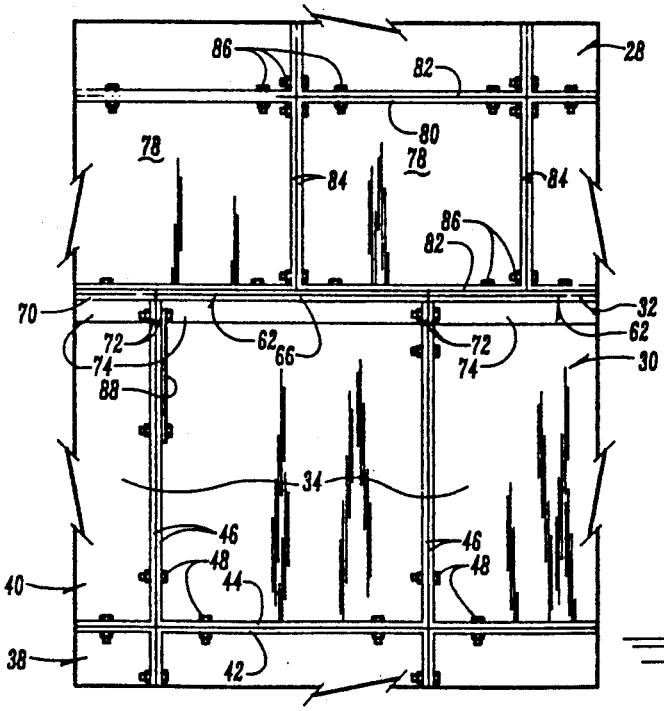
FIG. 6 is a partial elevational view taken along line 5—5 of FIG. 4.

Referring to FIG. 5, the form segments 34 are joined together in combination with a key panel 50 which is comprised of a key part 52 and a key part 54. Key part 52 includes a first flange 56 and a diverging flange 58. Key part 54 also includes a first flange 59 and a converging flange 61 which is bolted to diverging flange 58 of key part 52. The flanges 58, 61 of key panel 50 permit the easy removal of the panels after the concrete has been poured in place and hardened. They can be removed by removing bolts 48 and slipping the panel parts 52, 54 out of place. This permits the remainder of the form assembly to be disassembled.

Prior to assembling the lower form assembly 28, a plurality of sewer pipe inserts 65 are slipped within the ends of sewer pipes 22. Insert 65 are shaped to fit around this outer cylindrical surface of the first ring 36 of lower form assembly 28. After inserting the insert 65, the lower ring 36 is assembled. As can be seen in FIG. 1, the inserts 65 protrude downwardly below the lower most edge of first ring 36 so as to permit fluid to flow through the troughs 21, 23 during the time that the form is being built and during the time that the manhole is being repaired. Rings 38, 40 are then assembled as shown in FIG. 1. Horizontal form assembly 32 is comprised of a plurality of wedge-shaped or pie-shaped webs 62 which are joined together by bolts to create a circular horizontal form having an outer circular edge 64 and an inner circular edge 66. Extending around outer circular edge 64 is an outer annular rim 68 which is placed on the undersurface of the web segment 62 and which provides reinforcement thereto. Similarly, an inner annular rim 70 extends around the inner circular edge 66. Further reinforcement is provided on the undersurface of horizontal form assembly 32 by means of a plurality of gusset flanges 72 and reinforcing ribs 74. Gusset flanges 72 are provided with holes for receiving bolts to join webs 62 together into the complete horizontal form assembly 32. A plurality of holes 76 are provided around the inner circular edge 66 of form assembly 32.

The upper form assembly 94 is comprised of a plurality of upper form segments 78 which are similar to the form segments 34 of lower form assembly 28 with the exception that the angle of curvature is smaller so that the resulting upper form assembly 30 has a smaller diameter than the lower form assembly 28. Each upper form segment 78 includes upper flange 80, a lower flange 82, and opposite side flanges 84. The upper form segment 78 are bolted together by bolts 86. Key panels (not shown) similar to key panels 50 are used to permit removal of the upper form segments 78 after repair of the manhole.

After lower form assembly 28 is constructed, the horizontal panel segments 60 are brought into the manhole and are assembled to create the horizontal form assembly 32. Horizontal form assembly 32 is then placed upon the upper edges of lower form assembly 28 in covering relation over the upper end of form assembly 28. The angled gusset flanges 72 help center the horizontal form assembly over the lower form assembly 28.

Further reinforcement is provided to the horizontal form assembly by means of a plurality of struts 88, each of which is bolted at its upper end to gusset 72 adjacent the inner circular edge 66 of the horizontal form assembly. The lower end of each strut 88 is bolted to one of the flanges 46 of the lower form segments 34 in lower form assembly 28.

Figure 4:
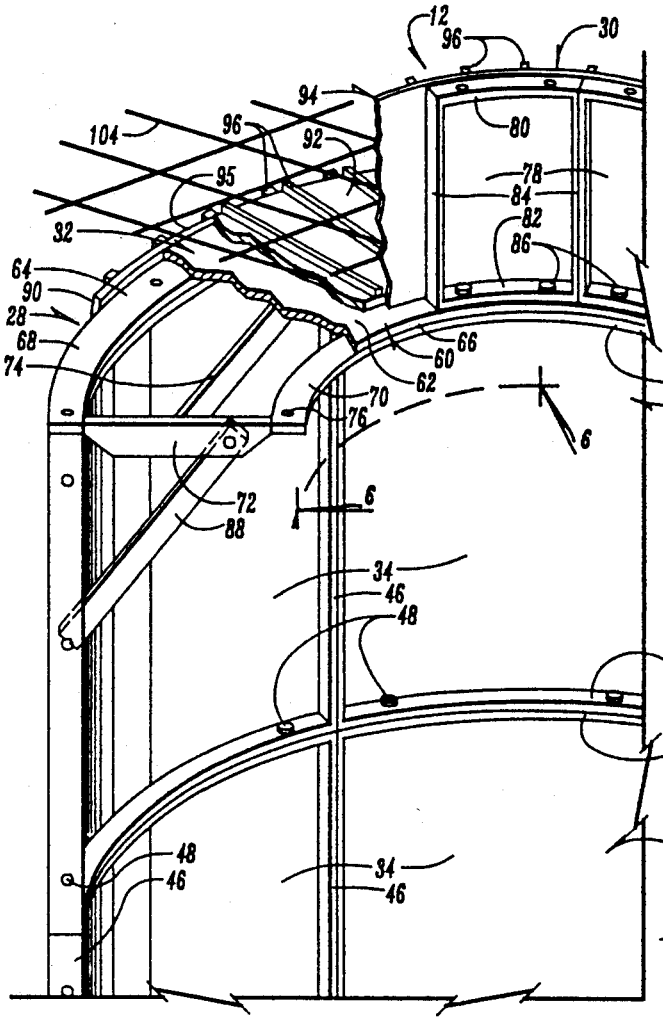
FIG. 4 is an enlarged detailed perspective showing portions of the form assembly cut away.

The upper form assembly 94 is assembled in registered alignment over the inner circular edge 66 of horizontal form assembly 32 and is bolted in place by means of bolts 86 as illustrated in FIG. 4.

If desired, during the construction of the lower form assembly 28, it is possible to cover each ring 36, 38, 40 with a lower plastic sheeting material 90. This plastic sheeting material is formed into plastic rings 91, 93, 95 which are placed over first, second, and third rings 36, 38, 40 respectively. They fit tightly around the outer surface of lower form assembly 28.

A horizontal plastic sheeting member 92 may be placed over the upper surface of horizontal form assembly 32, and an upper plastic sheeting member 94 may be placed in surrounding relationship around the upper form assembly 30. All of the sheeting material includes a plurality of ribs 96 which protrude outwardly from the outer surface of the form system 12.

When fully assembled, the form system 12 leaves a lower annular space 98 between lower form assembly 28 and lower cylindrical wall 14, a horizontal space 100 between horizontal form assembly 32 and annular horizontal wall 18, and an upper annular space 102 between the upper form assembly 30 and the upper cylindrical wall 16 of the manhole 10. A reinforcing wire 104 can be placed in the horizontal space 100 so as to provide strengthening of the concrete once it is poured in this space.

After the form assembly has been completed, concrete is poured into the lower horizontal space 98, horizontal space 100, and upper annular space 102 to create the newly formed wall for the manhole. The concrete surrounds and embeds the ribs 96 of the plastic sheet material and causes the plastic material to be bonded to the concrete. After the concrete has hardened, the form system 12 can be removed from the manhole. First, the lower ring 36 is disassembled and removed. Then the inserts 65 can be removed from the sewer pipes 22.

Disassembling continues progressing from the bottom of the manhole to the top. Once the third ring 40 is disassembled, it is possible to remove the struts 88 and disassemble the horizontal form assembly 32. Finally, the upper form assembly 30 is disassembled, and the repair of the manhole is complete. Any seams between the various plastic sheets can be sealed by heat sealing so that the plastic sheet provides a corrosion resistant surface for the wall of the reconditioned manhole. Thus, it can be seen that the device accomplishes at least all of its stated objectives.

I claim:

1. A casting form assembly for casting a lining wall in an existing manhole comprising an upstanding lower cylindrical sidewall having a first diameter and upper and lower ends, an upstanding upper cylindrical sidewall having upper and lower ends and having a second diameter smaller than said first diameter, and a substantially horizontal annular wall joining said upper end of said lower cylindrical wall to said lower end of said upper cylindrical wall, said form assembly comprising:

a lower form assembly comprising a plurality of ring forms stacked vertically upon one another in radially inwardly spaced relation to said lower cylindrical sidewall of said existing manhole, each of said ring forms comprising a plurality of ring segments joined to one another, said lower form assembly having an outer cylindrical surface and an upper circular edge spaced below said horizontal annular wall of said manhole;

an annular horizontal form assembly supported by said upper circular edge of said lower form assembly and having an upwardly presented horizontal surface in downward spaced relation from said horizontal annular wall of said manhole;

said horizontal form assembly having an outer circular edge spaced radially outwardly from said upper sidewall of said manhole and having an inner circular edge spaced radially inwardly from said upper sidewall of said manhole;

an upper form assembly having an outer cylindrical surface spaced radially inwardly from said cylindrical upper sidewall of said manhole, said upper form assembly having a circular bottom edge registered with said inner circular edge of said horizontal form assembly and having an upper edge;

first securing means for securing said bottom edge of said upper form assembly to said inner circular edge of said horizontal form assembly;

said horizontal form assembly comprising a plurality of horizontal form segments; and second securing means for detachably securing said horizontal form segments together.

2. A casting form assembly according to claim 1 wherein said second securing means are located below said horizontal form assembly so as to be accessible from below said horizontal form assembly for detaching said horizontal form segments from one another.

3. A casting form assembly according to claim 2 wherein said horizontal form segments each comprises side flanges, said second securing means engaging said side flanges to secure said horizontal form segments together.

4. A casting form assembly according to claim 1 comprising strut means having a first end operatively connected to said horizontal form assembly adjacent said inner circular edge thereof and having a second end connected to said lower form assembly at a point spaced below said horizontal form assembly.

5. A casting form assembly according to claim 1 comprising a plastic sheet material covering said outer cylindrical surface of said lower form assembly, said upwardly presented surface of said horizontal form assembly, and said outer cylindrical surface of said upper form assembly.

6. A casting form assembly according to claim 5 wherein said plastic sheet material includes an outer surface facing away from said lower form assembly, said horizontal form assembly, and said upper form assembly, said outer surface having a plurality of projecting surfaces thereon.

7. A method for casting a lining wall in an existing manhole, said manhole comprising an upstanding lower cylindrical sidewall having a first diameter and upper and lower ends, an upstanding upper cylindrical sidewall having upper and lower ends and having a second diameter smaller than said first diameter, and a substantially horizontal annular wall joining said upper end of said lower cylindrical wall to said lower end of said upper cylindrical wall, said method comprising:

assembling a plurality of lower form segments together within said manhole into a lower form assembly within said manhole, said lower form assembly comprising an upper circular edge spaced below said horizontal annular wall of said manhole and an outer cylindrical surface spaced radially inwardly from said lower cylindrical sidewall of said manhole to form a lower annular space therebetween;

assembling a plurality of horizontal form segments within said manhole into a horizontal form assembly suppported by said upper circular edge of said lower form assembly in downward spaced relation to said horizontal annular wall of said manhole so as to form a horizontal space therebetween, said horizontal form assembly having an outer circular edge spaced radially outwardly from said upper sidewall of said manhole and having an inner circular edge spaced radially inwardly from said upper sidewall of said manhole;

assembling a plurality of upper form segments within said manhole into an upper form assembly having an outer cylindrical surface spaced radially inwardly from said cylindrical upper sidewall of said manhole so as to form an upper annular space therebetween and having a circular bottom edge registered with and engaging said inner circular edge of said horizontal form assembly, said upper annular space, said horizontal space, and said lower annular space being in communication with one another;

pouring concrete into said upper annular space, said horizontal space, and said lower annular space;

permitting said concrete to harden;

disassembling said lower form assembly, said horizontal form assembly, and said upper form assembly;

removing said lower form segments, said horizontal form segments, and said upper form segments from said manhole.

8. A method according to claim 7 comprising before pouring said concrete the step of placing a plastic sheet material in covering relation around said lower form assembly, above said horizontal form assembly and around said upper form assembly, said plastic sheet material being spaced from said lower sidewall, said annular horizontal wall, and said upper sidewall of said manhole, whereby said plastic sheet material forms a plastic liner to the inside surface of said concrete after said concrete is poured and hardened.

* * * * *